US010955771B2

(12) United States Patent
Kumagai et al.

(10) Patent No.: US 10,955,771 B2
(45) Date of Patent: Mar. 23, 2021

(54) BELT CONTROL DEVICE AND IMAGE FORMING APPARATUS INCORPORATING SAME

(71) Applicants: Naohiro Kumagai, Kanagawa (JP); Masanari Fujita, Tokyo (JP); Katsuya Kawagoe, Kanagawa (JP); Masaharu Furuya, Kanagawa (JP); Hiroki Nakamatsu, Kanagawa (JP); Yoshiki Hozumi, Kanagawa (JP)

(72) Inventors: Naohiro Kumagai, Kanagawa (JP); Masanari Fujita, Tokyo (JP); Katsuya Kawagoe, Kanagawa (JP); Masaharu Furuya, Kanagawa (JP); Hiroki Nakamatsu, Kanagawa (JP); Yoshiki Hozumi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/816,266

(22) Filed: Mar. 12, 2020

(65) Prior Publication Data

US 2020/0301321 A1 Sep. 24, 2020

(30) Foreign Application Priority Data

Mar. 18, 2019 (JP) ..... JP2019-049771
Jan. 24, 2020 (JP) ..... JP2020-010115

(51) Int. Cl.
*G03G 15/00* (2006.01)
*G03G 15/16* (2006.01)

(52) U.S. Cl.
CPC ..... *G03G 15/1615* (2013.01); *G03G 2215/00151* (2013.01); *G03G 2215/00168* (2013.01)

(58) Field of Classification Search
CPC ..... G03G 15/1615; G03G 15/2053; G03G 15/755; G03G 2215/00151; G03G 2215/00168; B65G 15/64
(Continued)

(56) References Cited

U.S. PATENT DOCUMENTS 8,886,102 B2 * 11/2014 Ishida ..... G03G 15/2053 399/329
9,238,552 B2 * 1/2016 Hozumi ..... B65G 23/44
(Continued)

FOREIGN PATENT DOCUMENTS

JP 2012-198293 10/2012
JP 2013-238818 11/2013
(Continued)

*Primary Examiner* — Robert B Beatty
(74) *Attorney, Agent, or Firm* — Xsensus LLP

(57) ABSTRACT

A belt control device includes a plurality of rollers, a belt wound around the plurality of rollers and configured to rotate along with the plurality of rollers, a belt contact member that the belt contacts when the belt moves in an axial direction of the plurality of rollers, and a shaft displacement member movable in the axial direction and including an inclined face inclined with respect to a surface of the belt to control movement of the belt in the axial direction. The belt, the belt contact member, and the shaft displacement member are configured to make a frictional force between an edge of the belt and the belt contact member greater than a frictional force between the belt contact member and the shaft displacement member.

7 Claims, 5 Drawing Sheets

(58) Field of Classification Search
USPC ..... 399/165, 302, 313, 329
See application file for complete search history.

(56) References Cited

U.S. PATENT DOCUMENTS

| | | | | |
|---|---|---|---|---|
| 9,869,951 | B2 * | 1/2018 | Okamoto | G03G 15/755 |
| 2011/0116847 | A1 * | 5/2011 | Wakana | G03G 15/161<br>399/313 |
| 2012/0234656 | A1 | 9/2012 | Yamaoka | |
| 2013/0306441 | A1 | 11/2013 | Asaoka et al. | |
| 2014/0008184 | A1 | 1/2014 | Hozumi et al. | |
| 2014/0083821 | A1 | 3/2014 | Hozumi et al. | |
| 2014/0183007 | A1 | 7/2014 | Hozumi et al. | |
| 2014/0209437 | A1 | 7/2014 | Hozumi et al. | |
| 2015/0117914 | A1 | 4/2015 | Hozumi et al. | |
| 2015/0125189 | A1 | 5/2015 | Hozumi et al. | |
| 2015/0227089 | A1 | 8/2015 | Hozumi et al. | |
| 2015/0301484 | A1 | 10/2015 | Hozumi et al. | |
| 2015/0314976 | A1 | 11/2015 | Hozumi et al. | |
| 2016/0251166 | A1 | 9/2016 | Hozumi et al. | |
| 2017/0242387 | A1 | 8/2017 | Hozumi et al. | |
| 2018/0120739 | A1 | 5/2018 | Hozumi | |
| 2018/0267437 | A1 | 9/2018 | Hozumi | |

FOREIGN PATENT DOCUMENTS

| | | |
|---|---|---|
| JP | 2014-010429 | 1/2014 |
| JP | 2014-095737 | 5/2014 |

* cited by examiner

BELT CONTROL DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2019-049771, filed on Mar. 18, 2019 and 2020-010115, filed on Jan. 24, 2020 in the Japan Patent Office, the entire disclosure of each of which is hereby incorporated by reference herein.

BACKGROUND

Technical Field

Embodiments of the present disclosure relate to a belt control device and an image forming apparatus incorporating the belt control device.

Description of the Related Art

In certain image forming apparatuses, a belt control device is employed to control an endless belt used as, in particular, an intermediate transfer belt. The belt control device includes the belt, a plurality of rollers that stretches and supports the belt, a rotator disposed at the end of one roller of the plurality of rollers. The rotator has an inclined face. When the belt meanders (i.e., when belt crawl occurs), an edge of the belt presses against the rotator, and the one roller is inclined according to the inclined face, thereby correcting belt crawl.

SUMMARY

Embodiments of the present disclosure describe an improved belt control device that includes a plurality of rollers, a belt wound around the plurality of rollers and configured to rotate along with the plurality of rollers, a belt contact member that the belt contacts when the belt moves in an axial direction of the plurality of rollers, and a shaft displacement member movable in the axial direction and including an inclined face inclined with respect to a surface of the belt to control movement of the belt in the axial direction. The belt, the belt contact member, and the shaft displacement member are configured to make a frictional force between an edge of the belt and the belt contact member greater than a frictional force between the belt contact member and the shaft displacement member.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
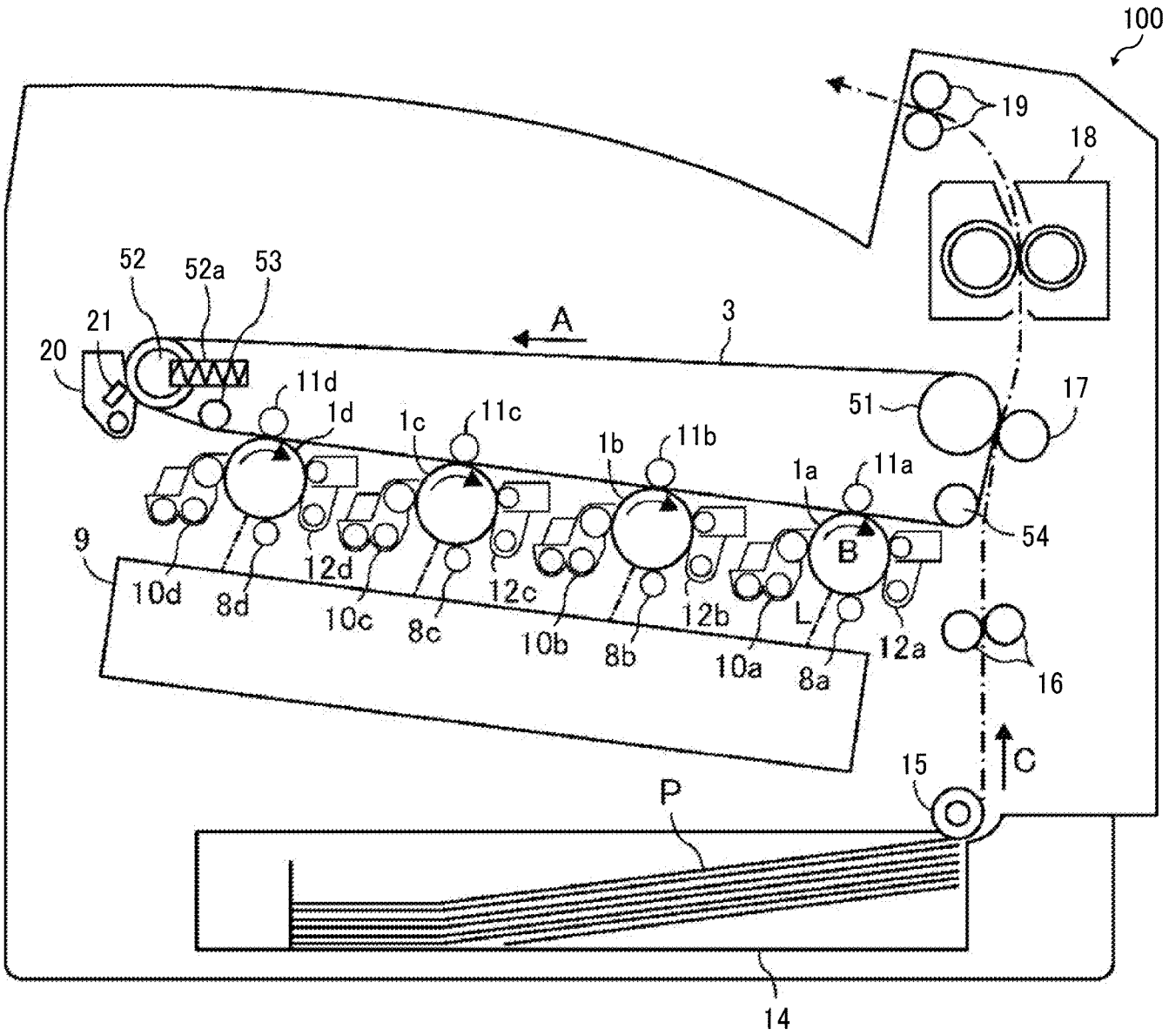
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

FIG. 1 illustrates an image forming apparatus 100 according to an embodiment of the present disclosure. The image forming apparatus 100 includes an intermediate transfer belt 3 that is a belt wound around a plurality of rollers and rotates along with the plurality of rollers.

The image forming apparatus 100 according to the present embodiment includes four photoconductors 1*a*, 1*b*, 1*c*, and 1*d* as image bearers for four colors of black, magenta, cyan, and yellow in a housing of the image forming apparatus 100.

Toner images of different colors are formed on the photoconductors 1*a*, 1*b*, 1*c* and 1*d*, respectively.

The intermediate transfer belt 3 serving as an intermediate transferor is disposed opposite the photoconductors 1*a*, 1*b*, 1*c*, and 1*d*. The photoconductors 1*a*, 1*b*, 1*c*, and 1*d* contact the surface of the intermediate transfer belt 3.

The intermediate transfer belt 3 is wound around a drive roller 51 and support rollers 52, 53, and 54 that rotate along with the drive roller 51.

In other words, the image forming apparatus 100 according to the present embodiment includes a belt that is wound around the plurality of rollers and rotates along with the plurality of rollers.

Here, the plurality of rollers includes the drive roller 51 and the support rollers 52, 53, and 54. Any one of the plurality of rollers is also referred to as, simply, "roller", unless distinguished.

A belt tension spring 52*a* is disposed near the support roller 52. The belt tension spring 52*a* applies elastic force to the support roller 52 in the direction away from the drive roller 51 and the support roller 53. With such a configuration, the intermediate transfer belt 3 entrained around the support roller 52 and other rollers is tensioned without slack to effect good transport of a sheet P.

Note that the belt tension spring 52*a* is, for example, a spring, a flat spring, rubber, or the like.

As the drive roller 51 is rotated by a driving source such as a motor, the intermediate transfer belt 3 rotates in the direction indicated by arrow A in FIG. 1.

The intermediate transfer belt 3 is either a multi-layer belt or a single-layer belt. In the case of the single-layer belt, the belt is preferably made of, for example, polyvinylidene fluoride (PVDF), polycarbonate (PC), polyimide (PI), or the like. In the case of the multi-layer belt, the intermediate transfer belt 3 preferably includes a base layer formed of a material, such as fluoroplastic, PVDF sheet, or polyimide resin, that is less stretchy, and a smooth coat layer formed of, for example, fluoroplastic that covers the surface of the base layer.

Regardless of the color of toner, the configurations to form toner images on the photoconductors 1*a*, 1*b*, 1*c*, and 1*d* are similar. Similarly, the configurations to transfer the toner images of four colors from the photoconductors 1*a*, 1*b*, 1*c*, and 1*d* onto the intermediate transfer belt 3 are similar, differing only in the color of toner employed therewithin.

Therefore, a description is given of only the configuration in which a black toner image is formed on the photoconductor 1*a* and transferred to the intermediate transfer belt 3 as representative, and the description of the configurations for other colors is omitted to avoid redundancy.

The photoconductor 1*a* is driven to rotate in the direction indicated by arrow B in

FIG. 1.

The photoconductor 1*a* is irradiated with light from a discharge device to initialize the surface potential of the photoconductor 1*a*.

A charging device 8*a* (8*b*, 8*c*, and 8*d*) is disposed near the photoconductor 1*a* (1*b*, 1*c*, and 1*d*) and uniformly charges the initialized surface of the photoconductor 1*a* (1*b*, 1*c*, and 1*d*) with a negative polarity.

An exposure device (optical scanning device) 9 optically scans on the surface of the photoconductor 1*a* with a laser beam L. The portion of the surface of the photoconductor 1*a* where the exposure device 9 has been irradiated with the laser beam L is discharged, thereby forming an electrostatic latent image on the surface of the photoconductor 1*a*.

A developing device 10*a* (10*b*, 10*c*, and 10*d*) contains toner to form a toner image for the color corresponding to the photoconductor 1*a* (1*b*, 1*c*, and 1*d*).

When the electrostatic latent image passes through the developing device 10*a*, toner adheres to the photoconductor 1*a* by electrostatic force. As a result, the electrostatic latent image on the photoconductor 1*a* is rendered visible as the toner image.

A transfer roller 11*a* (11*b*, 11*c*, and 11*d*) is disposed opposite the photoconductor 1*a* (1*b*, 1*c*, and 1*d*) via the intermediate transfer belt 3. A positive transfer voltage in polarity opposite the charges of the toner image formed on the photoconductor 1*a* is applied to the transfer roller 11*a*.

The transfer voltage generates a transfer electric field between the photoconductor 1*a* and the intermediate transfer belt 3, and the toner image on the photoconductor 1*a* is transferred to the surface of the intermediate transfer belt 3 that rotates in synchronization with the photoconductor 1*a*.

After the transfer process, the cleaning device 12*a* (12*b*, 12*c*, and 12*d*) removes residual toner on the surface of the photoconductor 1*a* (1*b*, 1*c*, and 1*d*), and then the discharge device initializes the surface potential of the photoconductor 1*a* (1*b*, 1*c*, and 1*d*) with light in preparation for next image formation.

Similarly, the toner images on the photoconductors 1*b*, 1*c*, and 1*d* disposed adjacent to the intermediate transfer belt 3 are electrostatically transferred one by one, thereby forming a composite toner image on the intermediate transfer belt 3.

A sheet feeder 14 is disposed at the bottom of the image forming apparatus 100, and a sheet feeding roller 15 rotates to feed a sheet P as a recording medium in the direction indicated by arrow C in FIG. 1. A registration roller pair 16 feeds the sheet P between the drive roller 51 and a secondary transfer roller 17 disposed opposite the drive roller 51. At that time, a predetermined transfer voltage is applied to the secondary transfer roller 17, thereby secondarily transferring the composite toner image on the intermediate transfer belt 3 to the sheet P.

The sheet P on which the composite toner image has been transferred is further transported upward and passes through a fixing device 18.

The fixing device 18 fixes the composite toner image on the sheet P with heat and pressure.

After the sheet P passes through the fixing device 18, the sheet P is ejected outside the housing of the image forming apparatus 100 by an output roller pair 19 of a sheet ejection section.

After the secondary transfer process, residual toner remaining on the intermediate transfer belt 3 is removed by a belt cleaning device 20.

In the present embodiment, the belt cleaning device 20 includes a linear cleaning blade 21 made of, for example, urethane. The cleaning blade 21 contact the intermediate transfer belt 3 to scrape off the residual toner.

In the present embodiment, only a configuration using, but not limited to, the cleaning blade 21 is described. Alternatively, for example, the belt cleaning device 20 may include a conductive fur brush to clean the intermediate transfer belt 3 electrostatically.

In the image forming apparatus 100 using the intermediate transfer belt 3, it is known that print quality largely depends on alignment of the toner image of each color, and therefore is affected by deviation of the intermediate transfer belt 3 (i.e., belt crawl), and the like.

Accordingly, the intermediate transfer belt 3 is required to remain tensioned, and to have a small deviation in the axial direction of the plurality of rollers around which the intermediate transfer belt 3 is wound.

Figure 2:
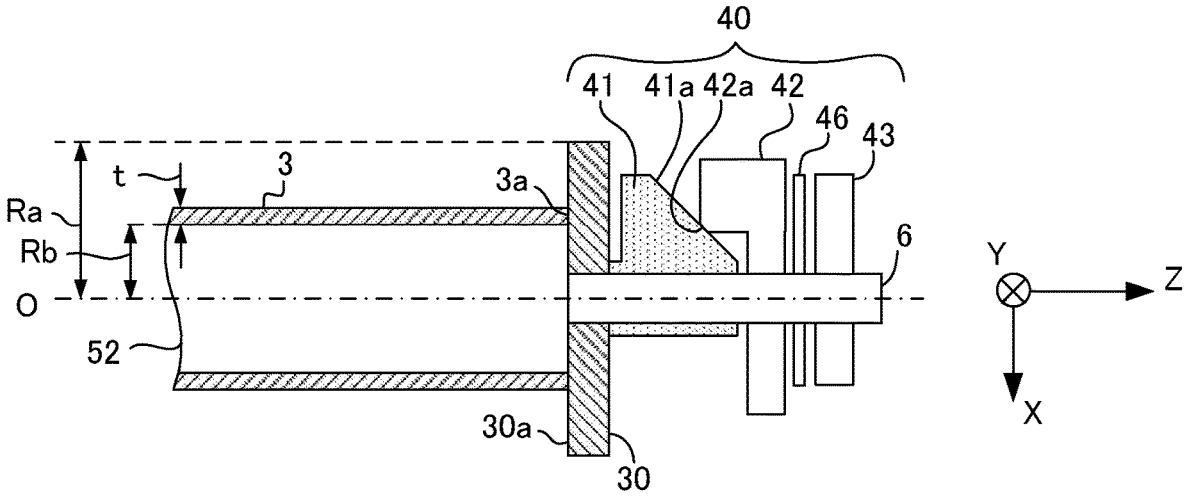
FIG. 2 is a schematic view illustrating an example of operation of a belt control device according to an embodiment of the present disclosure.

Therefore, in the present embodiment, as illustrated in FIG. 2, the image forming apparatus 100 includes a belt position correction unit 40 serving as a belt control device for reducing deviation of the intermediate transfer belt 3 due to the rotation of the intermediate transfer belt 3.

The belt position correction unit 40 is provided, at least, at one axial end of one of the plurality of rollers around which the intermediate transfer belt 3 is wound. In the following description, the belt position correction unit 40 is disposed at one end of the support roller 52. However, the belt position correction unit 40 may be provided on one or more rollers other than the support roller 52.

The belt position correction unit 40 is provided on one side of the support roller 52 of the image forming apparatus 100 in FIG. 1. FIG. 2 is a longitudinal cross-sectional view illustrating the support roller 52.

As illustrated in FIG. 2, the belt position correction unit 40 includes a roller shaft 6 having an axis of rotation coaxial with the support roller 52, positioned at the end of the support roller 52.

The belt position correction unit 40 also includes a shaft displacement member 41 and a shaft guide 42. The shaft displacement member 41 is attached to the roller shaft 6 and has an inclined face 41*a* inclined with respect to the roller shaft 6 and the surface of the intermediate transfer belt 3. The shaft guide 42 contacts the inclined face 41*a* to guide the shaft displacement member 41.

The belt position correction unit 40 further includes a roller shaft support 43 that supports the roller shaft 6, a stationary portion 46, and a support spring 45 (see FIG. 4) that couples the stationary portion 46 and the roller shaft support 43 to urge the roller shaft support 43 in the Y-direction.

The roller shaft 6 has a columnar shape having a diameter smaller than that of the support roller 52. The roller shaft 6 traverses the support roller 52, a belt contact member 30 described later, the shaft displacement member 41, and the roller shaft support 43.

The roller shaft 6 and the support roller 52 are formed as a single piece and rotate together.

The belt contact member 30 is disk-shaped and disposed at the end of the support roller 52. The belt contact member is movable in the Z direction, which is the axial direction of the roller shaft 6.

The belt contact member 30 has a flat face 30*a* perpendicular to the Z direction. The periphery of the flat face 30*a* forms a circle centered on the support roller 52 or the roller shaft 6. As an edge (belt edge 3*a*) of the intermediate transfer belt 3 contacts the flat face 30*a*, the belt contact member 30 moves in the Z direction. That is, when the deviation of the intermediate transfer belt 3 (i.e., belt crawl) occurs, the belt edge 3*a* presses the belt contact member 30 in the Z direction, so that the belt contact member 30 moves in the Z direction. As described above, the flat face 30*a* serves as a belt edge contact portion where the belt edge 3*a* contacts the belt contact member 30 when the intermediate transfer belt 3 moves in the Z direction (in particular, the direction from center to end of the support roller 52).

A radius Ra of the circular periphery of the flat face 30*a* is larger than a combined length of a radius Rb of the support roller 52 plus a thickness t of the intermediate transfer belt 3 so as to prevent the intermediate transfer belt 3 from becoming stranded on the belt contact member 30 and coming off the support roller 52 when the belt edge 3*a* moves and contacts the flat face 30*a*.

In the present embodiment, the radius Rb of the support roller 52 is 8.78 mm, the thickness t of the intermediate transfer belt 3 is 80 μm, and the radius Ra of the circular periphery of the flat face 30*a* is 9.00 mm (>8.86 mm).

Note that the belt contact member 30 may have any shape other than the disk shape described above. In such a case, the shortest distance from the periphery of the belt contact member 30 to the center of the roller shaft 6 corresponds to the radius Ra of the circular periphery of the flat face 30*a*.

The belt contact member 30 is not secured to the support roller 52 and the roller shaft 6, and freely rotatable coaxially to the axis of the support roller 52 in the X-Y plane as illustrated in FIG. 2.

For this reason, the belt contact member 30 is driven to rotate along with the intermediate transfer belt 3 rotating in the direction indicated by arrow A in FIG. 1 by friction between the belt edge 3*a* and the flat face 30*a*.

The belt contact member 30 is preferably made of a material softer than that of the intermediate transfer belt 3 so as not to damage the belt edge 3*a* of the intermediate transfer belt 3.

Figure 3:
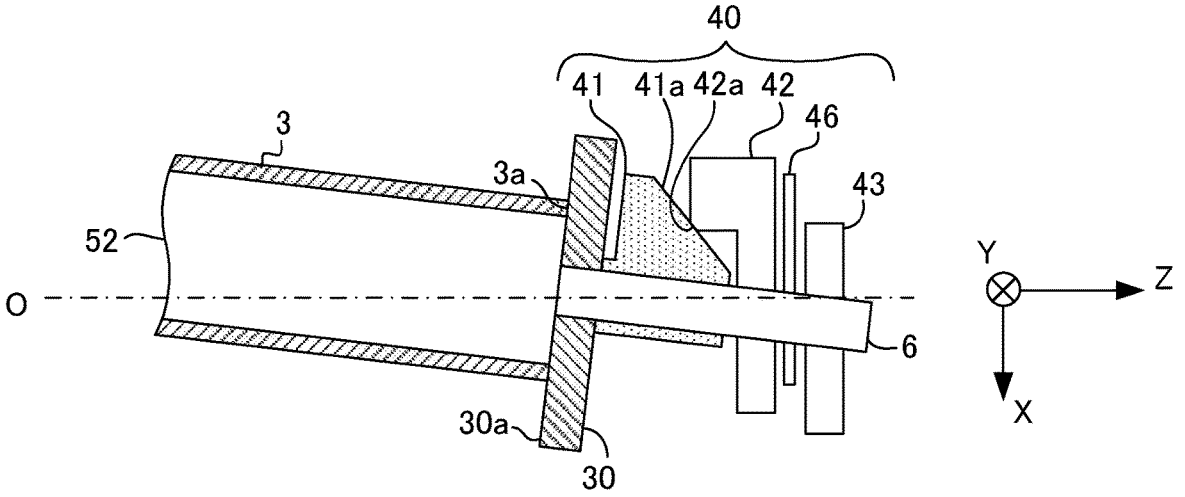
FIG. 3 is a schematic view illustrating another example of operation of the belt control device illustrated in FIG. 2.
Figure 4:
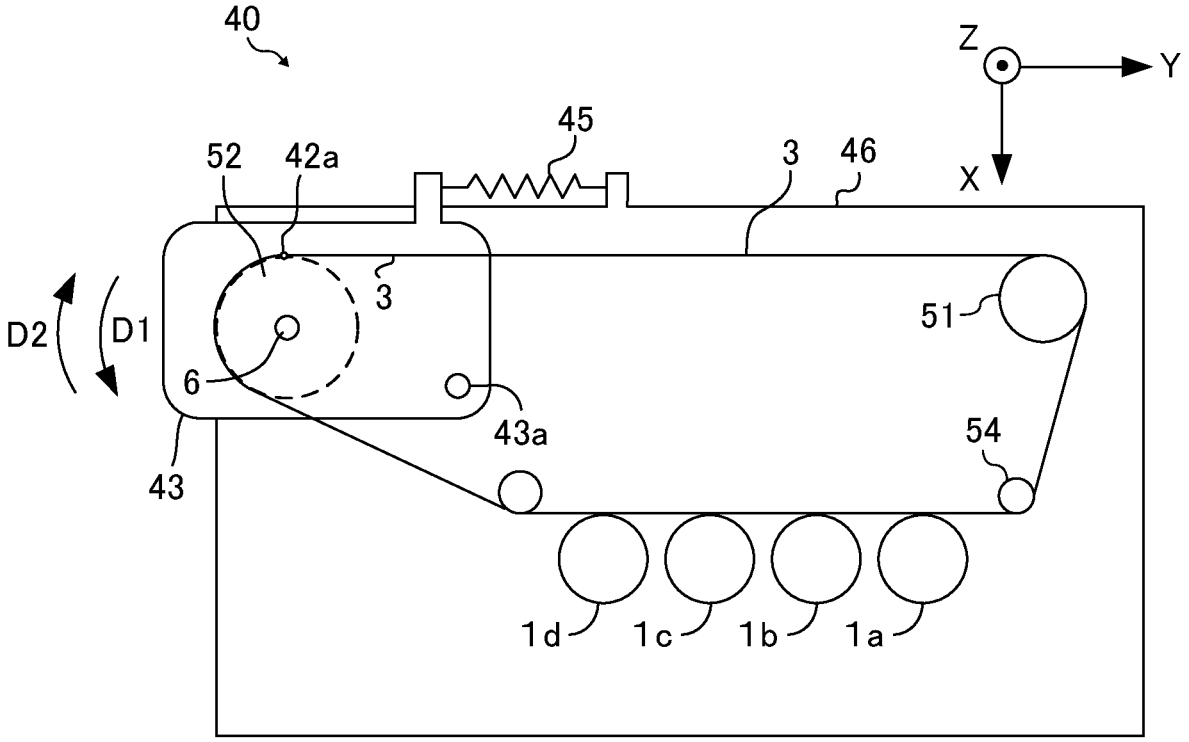
FIG. 4 is a schematic view illustrating an example of configuration of the belt control device according to an embodiment of the present disclosure.

The belt position correction unit 40 returns the intermediate transfer belt 3 to the original position when the intermediate transfer belt 3 moves in the Z direction. A description is given below of the belt position correction unit 40 with reference to FIGS. 2 to 4. FIG. 3 is a schematic view illustrating a state in which the support roller 52 and the roller shaft 6 illustrated in FIG. 2 are inclined. FIG. 4 is a schematic view of the belt position correction unit 40 in FIG. 2 as viewed in the Z direction.

As the drive roller 51 is rotated by the driving source, the intermediate transfer belt 3 is driven to rotate along with the drive roller 51 in the direction indicated by arrow A in FIG. 1. At that time, in FIGS. 2 and 3, the intermediate transfer belt 3 travels in the Y direction (i.e., travel direction), and the support roller 52 also rotates along with the intermediate transfer belt 3.

The intermediate transfer belt 3 may move in the axial direction (Z direction) of the plurality of rollers due to, for example, the fact that the plurality of rollers, around which the intermediate transfer belt 3 is wound, are not parallel to each other.

An inward face in the Z direction of the shaft displacement member 41 contacts the belt contact member 30.

As the belt edge 3*a* moves in the Z direction and presses the belt contact member 30 outward, the shaft displacement member 41 is pressed by the belt contact member 30 and moves outward in the Z direction.

As described above, the shaft displacement member 41 is guided by the shaft guide 42 while the inclined face 41*a* contacts a contact portion 42*a* of the shaft guide 42. Accordingly, as the shaft displacement member 41 moves outward in the Z direction, the contact portion 42*a* contacts an upper portion of the inclined face 41*a*. As a result, the shaft displacement member 41 is displaced downward in the X direction and the roller shaft 6 penetrating through the shaft displacement member 41 are inclined (see FIG. 3).

As illustrated in FIG. 4, the roller shaft support 43, through which the roller shaft 6 penetrates, is secured to the stationary portion 46 at a support center 43*a* of the roller shaft support 43. Accordingly, when the end of the roller shaft 6 is displaced downward in the X direction together with the shaft displacement member 41, the roller shaft support 43 is rotated around the support center 43*a* in the direction indicated by arrow D1 in FIG. 4 and inclined.

The support spring 45 couples the roller shaft support 43 to the stationary portion 46 secured to the housing of the image forming apparatus 100. The stationary portion 46 does not move with the movement of the roller shaft 6.

With this configuration, even when the roller shaft support 43 moves in the direction indicated by arrow D1 in FIG. 4, resilience is exerted by the support spring 45 to urge the roller shaft support 43 in the direction indicated by arrow D2 (X direction). That is, when there is no deviation of the intermediate transfer belt 3 (belt crawl), the belt position correction unit 40 can return to the reference position as illustrated in FIG. 2 by the resilience of the support spring 45.

Among the above-described components, the support roller 52, the roller shaft 6, the belt contact member 30, and the belt position correction unit 40 constitute a roller unit.

Further, the roller shaft 6 and the roller shaft support 43 that hold the shaft displacement member 41 constitute a shaft displacement member holder.

Even when the intermediate transfer belt 3 moves in the Z direction (i.e., belt crawl occurs), the shaft displacement member 41 is displaced downward and the roller shaft 6 is inclined due to the operation of the belt position correction unit 40 and the belt contact member 30. As a result, the movement of the intermediate transfer belt 3 in the Z direction is minimized or the intermediate transfer belt 3 is restored to the original position.

Figure 5:
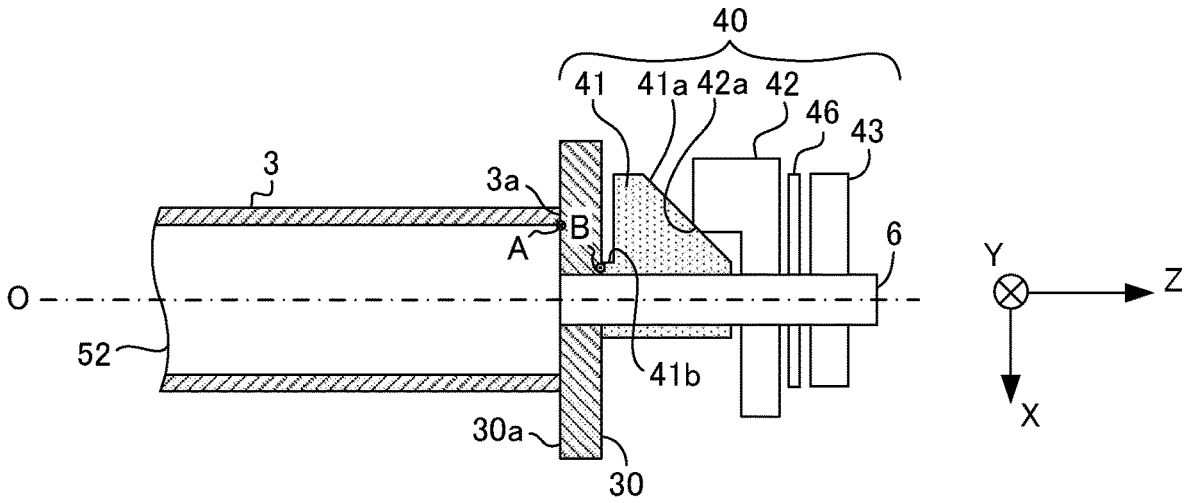
FIG. 5 is a schematic view illustrating an example of configuration of the belt control device according to an embodiment of the present disclosure.

However, in such a configuration, as illustrated in FIG. 5, the belt contact member 30 is driven to rotate by a frictional force A between the intermediate transfer belt 3 and the belt contact member 30. The ideal rotation speed of the belt contact member 30 is exactly the same as that of the intermediate transfer belt 3, but there is a difference in linear velocity between the belt contact member 30 and the intermediate transfer belt 3 in practice.

Further, the belt contact member 30 also contacts the shaft displacement member 41, and the shaft displacement member 41 does not rotate along with the roller shaft 6. Therefore, a frictional force B due to the contact with the shaft displacement member 41 also cause the difference in linear velocity.

When such a difference in linear velocity is generated, the belt contact member 30 is worn by the intermediate transfer belt 3, and the dust generated at that time adversely affects the toner image carried on the intermediate transfer belt 3.

Therefore, in the present embodiment, as illustrated in FIG. 5, the frictional force A between the belt edge 3*a* and the belt contact member 30 is greater than the frictional force B between the belt contact member 30 and the shaft displacement member 41 (i.e., A>B). Specifically, the shaft displacement member 41 includes a protrusion 41*b* protruding toward the belt contact member 30. Therefore, the contact area between the shaft displacement member 41 and the belt contact member 30 is deliberately decreased to reduce the frictional force B between the belt contact member 30 and the shaft displacement member 41.

More specifically: As the intermediate transfer belt 3 meanders and presses the belt contact member 30 in the Z direction, the belt contact member 30 contacts the shaft displacement member 41. Then, the belt contact member 30 receives the frictional force A from the intermediate transfer belt 3 in the direction of rotation of the intermediate transfer belt 3 (i.e., the travel direction or the Y direction) and the frictional force B from the shaft displacement member 41 in the direction opposite the travel direction. The frictional force B is a force to stop the rotation of the belt contact member 30.

If the frictional force A is greater than the frictional force B, a force in the direction in which the belt contact member 30 rotates along with the intermediate transfer belt 3 increases, so that the difference in linear velocity between the belt contact member 30 and the intermediate transfer belt 3 can be reduced.

However, if the frictional force A is not more than the frictional force B, the belt contact member 30 does not follow the rotation of the intermediate transfer belt 3 due to a frictional resistance from the shaft displacement member 41, so that the difference in linear velocity between the belt contact member 30 and the intermediate transfer belt 3 increases. As a result, the belt contact member 30 and the intermediate transfer belt 3 are likely to be worn.

In the above-described embodiment, the contact area between the shaft displacement member 41 and the belt contact member 30 is reduced by the protrusion 41*b* of the shaft displacement member 41. Alternatively, in another embodiment as illustrated in FIG. 6, a sliding member 47 is disposed between the belt contact member 30 and the shaft displacement member 41 to improve the slidability therebetween so that the frictional force A between the belt edge 3*a* and the belt contact member 30 is greater than the frictional force B between the belt contact member 30 and the shaft displacement member 41.

The sliding member 47 is, for example, a fluoroplastic film or sheet, or a lubricant.

Figure 6:
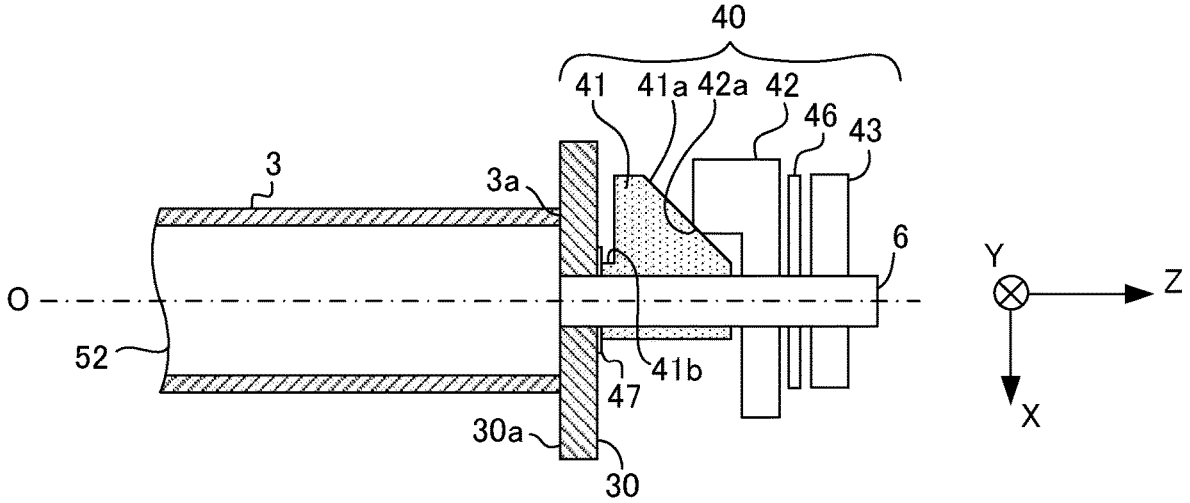
FIG. 6 is a schematic view illustrating an example of configuration of a sliding member of the belt control device according to an embodiment of the present disclosure.

In the embodiment as illustrated in FIG. 6, the protrusion 41*b* included in the shaft displacement member 41 reduces the contact area with the belt contact member 30, and the sliding member 47 is disposed between the protrusion 41*b* and the belt contact member 30.

Figure 7:
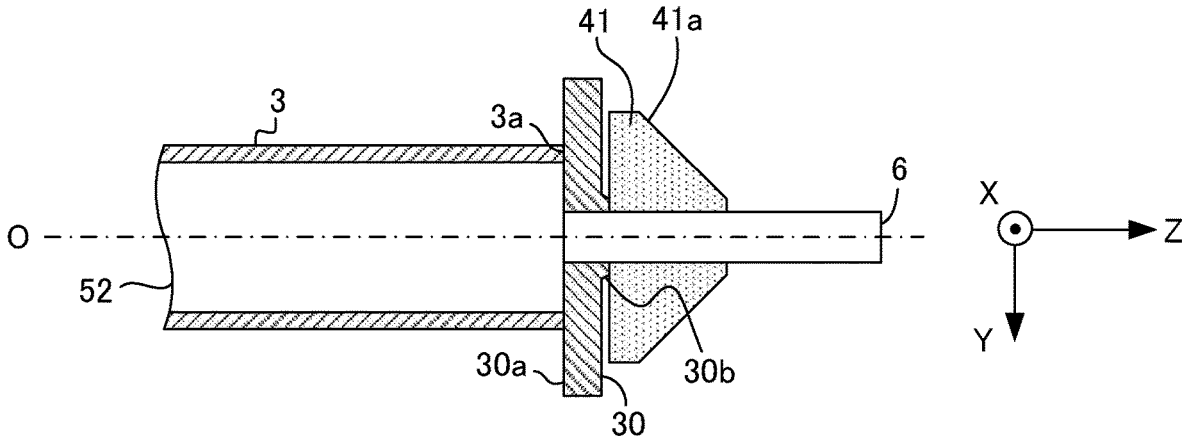
FIG. 7 is a schematic view illustrating an example of another configuration of the belt control device according to an embodiment of the present disclosure.

Alternatively, in yet another embodiment as illustrated in FIG. 7, a projection 30*b* protruding toward the shaft displacement member 41 is disposed on a face of the belt contact member 30 opposite the shaft displacement member 41 to reduce the contact area between the belt contact member 30 and the shaft displacement member 41.

With such configurations, when the belt contact member 30 rotates along with the intermediate transfer belt 3, the frictional resistance between the belt contact member 30 and the shaft displacement member 41 can be reduced.

Further, in addition to the configuration to reduce the contact area between the shaft displacement member 41 and the belt contact member 30, a configuration to increase the frictional force A between the intermediate transfer belt 3 and the belt contact member 30 can be employed.

For example, the surface roughness or the friction coefficient of an area of the belt contact member 30 that contacts the intermediate transfer belt 3 may be greater than the surface roughness or the friction coefficient of the face of the belt contact member 30 opposite the shaft displacement member 41.

As described above, according to the present disclosure, a belt control device can reduce a frictional resistance when a rotator (the belt contact member 30) of a belt control device rotates along with a belt.

The above-described embodiments are just examples and do not limit the present disclosure. Modifications and alterations of the embodiments can be made without departing from the spirit and scope of the disclosure described in the claims unless limited in the above description.

What is claimed is:

1. A belt control device, comprising:

a plurality of rollers;

a belt wound around the plurality of rollers and configured to rotate along with the plurality of rollers;

a belt contact member that the belt contacts when the belt moves in an axial direction of the plurality of rollers; and a shaft displacement member movable in the axial direction and including an inclined face inclined with respect to a surface of the belt to control movement of the belt in the axial direction, wherein the belt, the belt contact member, and the shaft displacement member being configured to make a frictional force between an edge of the belt and the belt contact member greater than a frictional force between the belt contact member and the shaft displacement member.

2. The belt control device according to claim 1, wherein the belt contact member includes a projection on a face of the belt contact member opposite the shaft displacement member, the projection protruding toward the shaft displacement member.

3. The belt control device according to claim 1, further comprising:

a sliding member disposed between the belt contact member and the shaft displacement member.

4. The belt control device according to claim 3, wherein the sliding member is a film or a sheet.

5. The belt control device according to claim 3, wherein the sliding member is a lubricant.

6. An image forming apparatus comprising the belt control device according to claim 1.

7. An image forming apparatus comprising the belt control device according to claim 3.

* * * * *